US006065296A

United States Patent [19]

Feger

[11] Patent Number: 6,065,296

[45] Date of Patent: May 23, 2000

[54] SINGLE PACKAGE VERTICAL AIR CONDITIONING SYSTEM

[75] Inventor: Gary K. Feger, San Antonio, Tex.

[73] Assignee: U.S. Natural Resources, Inc., San Antonio, Tex.

[21] Appl. No.: 09/144,224

[22] Filed: Aug. 31, 1998

[51] Int. Cl.[7] ..... F25B 45/00

[52] U.S. Cl. ..... 62/77; 62/259.1; 62/298; 62/150; 62/280; 62/291; 62/285; 62/97; 62/404

[58] Field of Search ..... 62/259.1, 298, 62/150, 280, 291, 285, 97, 404, 77

[56] References Cited

U.S. PATENT DOCUMENTS

| | | | |
|---|---|---|---|
| 4,449,376 | 5/1984 | Draper et al. | 62/259.1 |
| 4,462,460 | 7/1984 | Braver | 165/26 |
| 5,034,033 | 7/1991 | Alsup, Jr. et al. . | |
| 5,140,830 | 8/1992 | Sawyer | 62/298 |
| 5,271,242 | 12/1993 | Addington | 62/285 |
| 5,284,027 | 2/1994 | Martin, Sr. | 62/291 |
| 5,619,864 | 4/1997 | Reedy | 62/428 |
| 5,622,058 | 4/1997 | Ramakrishnan et al. . | |
| 5,638,695 | 6/1997 | Kamio et al. | 62/279 |

OTHER PUBLICATIONS

Heat Pump Service Manual, Models: CDHP18, CDHP24, CDHP 30 Published Dec. 3, 1990.

Heat Pump Installation Manual, Models: CDHP18, CDHP24, CDHP30, DHP35; Publication Dec. 3, 1990.

Heap Pump Service Manual, Model CDHP–35 Publication Mar. 22, 1990.

Sales brochure for CDHP Series.

Greg A. Mazurkiewicz, "Insider Heat Pump Gets Inside Track on Manufactured Hones," Air Conditioning, Heating and Refrigetation News, Apr. 7, 1997, p. 29.

Marvair, Sixpac Air Conditioner Sales Brochure.

WeatherWafer, Air Conditioners and Heat Pumps Sales Brochure.

Installation and Maintenance Instructions PWC Series, Self–Contained Heat Pump.

Carrier 50 CP/QP Master Price List.

Retroaire, Installation Operation and Maintenance Manual.

Tri–Pac, CPH Series, Compact Water Heater Sales Brochure.

*Primary Examiner*—Henry Bennett
*Assistant Examiner*—Mark Shulman
*Attorney, Agent, or Firm*—Gunn, Lee & Keeling

[57] ABSTRACT

This disclosure features a single package vertical air conditioner (both evaporator and condenser) in an easily installed cabinet. The cabinet includes a chassis above a dual level drain pan having a sump. The pan sits on a set of rubber feet to enable mounting. Side openings align with a telescoping two part plenum to connect to a louvered grill on the outside of a building to enable fresh air input and heat exchange.

26 Claims, 6 Drawing Sheets

SINGLE PACKAGE VERTICAL AIR CONDITIONING SYSTEM

BACKGROUND TO THE DISCLOSURE

The present disclosure is directed to a single package air conditioning system. It is a device which is readily manufactured and shipped in a single upright box. In the field where it is installed, it is easily installed and with great facility and service. The advent of this apparatus overcomes several problems that relate to installation. The system can provide complete climate control in a typical hotel room or multi-room applications, but it is far more versatile than that. It is versatile in the sense that a single unit can be installed adjacent to an outer wall of a building and yet have ducts directed to various rooms of the interior of the building. This unit has the versatility and convenience of a thru-the-wall packaged terminal air conditioner (PTAC) or room air product, while providing the function of unitary or split system air conditioners.

Extensive hollow duct work is not necessarily needed. Rather, the unit provides a relatively slim profile which enables it to be recessed in the back corner of a closet, or at the intersection of two rooms with an outer wall. By installing in this manner, it permits a single unit to accommodate a variety of floor plans. Moreover, it enables air conditioning capacity to be brought to a two or three room hotel or apartment, rest home for the elderly requiring assisted care, and a number of other circumstances. In that sense, it functions much more like a central air conditioning system without the difficulties of installation of that device. A central air conditioning system comprises two sets of equipment. One is installed inside the apartment, house, or other conditioned area. The other set of equipment is typically located outside the building. The two sets of equipment require the condenser and evaporator to be spaced far apart, thereby requiring a line set between the two to provide a closed cycle refrigerant flow system. It is not so with the present equipment.

This device has an evaporator and condenser which are installed in a single cabinet. While single cabinet air conditioners have been done here before, most often they have the shape of a window unit. Window units have been designed to simply fit into a wall or window opening. Heat is rejected by the unit through the back end which hangs out in space through the wall. This unit comprises a plenum extending from the unit to the exterior through the outside wall. The plenum however is telescoping. This device sets forth a telescoping plenum scheme allows the system to be uniformly manufactured and yet can be installed in a large variety of openings through the outside wall.

This unit comprises a system which can be demounted from a simple shipping carton and installed in a variety of locations. In a northern climate, it may be installed in a wall which is quite thick. Consider as an example a framed wall of 2×4 construction having an inside layer of sheet rock and outside layer of sheet plywood, and then a layer of bricks. Ultimately, that forms a wall of substantial thickness, ranging to about ten inches in thickness. In southern climates, the wall may not be that thick, and may be only half that thickness. Again, the wall might be constructed with sheet rock and some kind of thermal barrier on the exterior. In that instance, the wall might be only half the thickness. Rather than require a different model, the device of the present disclosure accommodates that problem. Rather than require hand-crafted construction of duct work, the present apparatus enables construction of a vent opening through which rejected heat is expelled. The rejected heat is blown out through the opening utilizing a telescoping plenum.

Window air conditioning units form condensate, which condensate normally drips from the back end of the unit on the outside of the building when the window air conditioner is operating. Two component systems (referring to separately located condenser and evaporator units) condense humidity from the air thereby creating collecting condensate in a drain pan. In more elaborate installations, the drain pan may be constructed with a drain tube extending from the drain pan to a drain line. The drain pan always creates a risk of water damage. As long as the passages are clear, the drain pan can collect water on a daily basis and deliver it out of the drain pan. That delivery route is normally through the drain line, pipe, hose, or other facility to get the water away from the drain pan. Assuming the drain line does not become plugged, this works quite well by gravity flow.

Trash and debris in the air may accumulate and create a sticky mess on the drain pan and may plug the openings. When that occurs, the drain pan may plug, thereby causing it to overflow, which may cause structural damage when the overflowing water flows under the framing or into the carpeted area. By contrast, this system incorporates a drain pan which contains the cold condensate water. It is allowed to accumulate to a specified level from which it is picked up by the propeller fan and splashed on the outdoor coil rejecting heat in the air conditioning cycle. When that occurs, the water is put to great use because the heat required to evaporate the water in turn keeps the condenser coil cooler, thereby enhancing heat rejection. Moreover, when water rises to that level, this drain pan incorporates an integrated structure which enables disposal of water overflow. That arrangement enables easy installation without requiring customized plumbing or tubing. While in one situation devices to the prior art might require only a 10 inch connection, just as readily another installation might need a 40 foot connection to the sanitation sewer line. That can easily add the requirement of specialized personnel (usually plumbers) and difficult connections into the sanitation sewer. That may also require added building permits to make added connection to the sewer system. All of this is avoided by the single package air conditioning system of the present disclosure.

This equipment allows the delivery of chilled air to the left or right or in both directions. Therefore, delivery may be the rooms where located or remotely into two separate rooms. It is also possible for the system to circulate and mix fresh air from the outside with the inside air to assure that the atmosphere does not become stale or stagnant.

Many advantages will be seen in the present equipment. One advantage worth noting is that the installed equipment is provided with appropriate shock absorbers. This equipment includes a hermetic compressor and single fan motor. In addition to the compressor, there is a separate fan motor. The fan motor drives a blower and an outdoor fan, thereby adding two pieces of rotating equipment. The rotating equipment creates vibration. The present system incorporates a set of rubber shock absorbing mounts underneath. The compressor has a separate set of rubber shock absorbers underneath the compressor. There is a problem, however, with simply furnishing the equipment on rubber mounts. These mounts have to be appropriately stabilized. This stabilization is all together different when the equipment is in the shipping carton. The rubber mounts sometimes get in the way at the time of installation. It is difficult to slide a large chassis like this into a confined place, skidding on shock absorbing feed underneath. This system includes a clip which enables the rubber feet to be stabilized so that they are vertically aligned. The rubber mounts function as isolators and establish a central or neutral position of the equipment in the off condition. The isolators bear the entire weight of the unit with no direct attachment to the building. Thereafter, when vibrations occur during operations, the range of excursion as a result of any vibration is minimal within the confined space. Installation is thereby more readily accomplished, and subsequent operation is less affected by inappropriate installation, i.e., the rubber isolators are mounted under the left and the right. In summary, the installation is achieved so that the vibration is confined in the cabinet and is not felt in the surrounding structure.

The present invention is summarized as a system in which the entire air conditioning unit is simply lifted out of a shipping carton and installed. The entire system has a quick disconnect harness, power cord that is easily disconnected and a duct that lends itself to a quick disconnect. Likewise, when a unit requires service, the unit can be easily replaced with a like unit without interrupting the comfort of the occupants. Various aspects of installation are made much more readily. Adaptability to the local architecture is particularly enhanced. By locating this equipment at the conjunction of an inside wall with the outside wall, the heat can be rejected to the exterior through a louvered opening while fresh air can be introduced into adjacent rooms. The entire system can be located in a closet, except for ducts to other rooms. Without regard to the thickness to the walls, adjustments can be made at the time of installation to assure that the equipment is on the inside of the building and yet venting to the exterior through the louvered opening is permitted. Finally, this system is installed for easy operation from a central location by means of a remote thermostat. Contrary to the circumstance of most thru-the-wall air conditioning units, air conditioning control for the equipment is made at a desired central location. In effect, remote installation of the thermostat results in more stable and satisfying operation.

DETAILED DESCRIPTION OF THE PREFERRED EMBODIMENT

Figure 1:
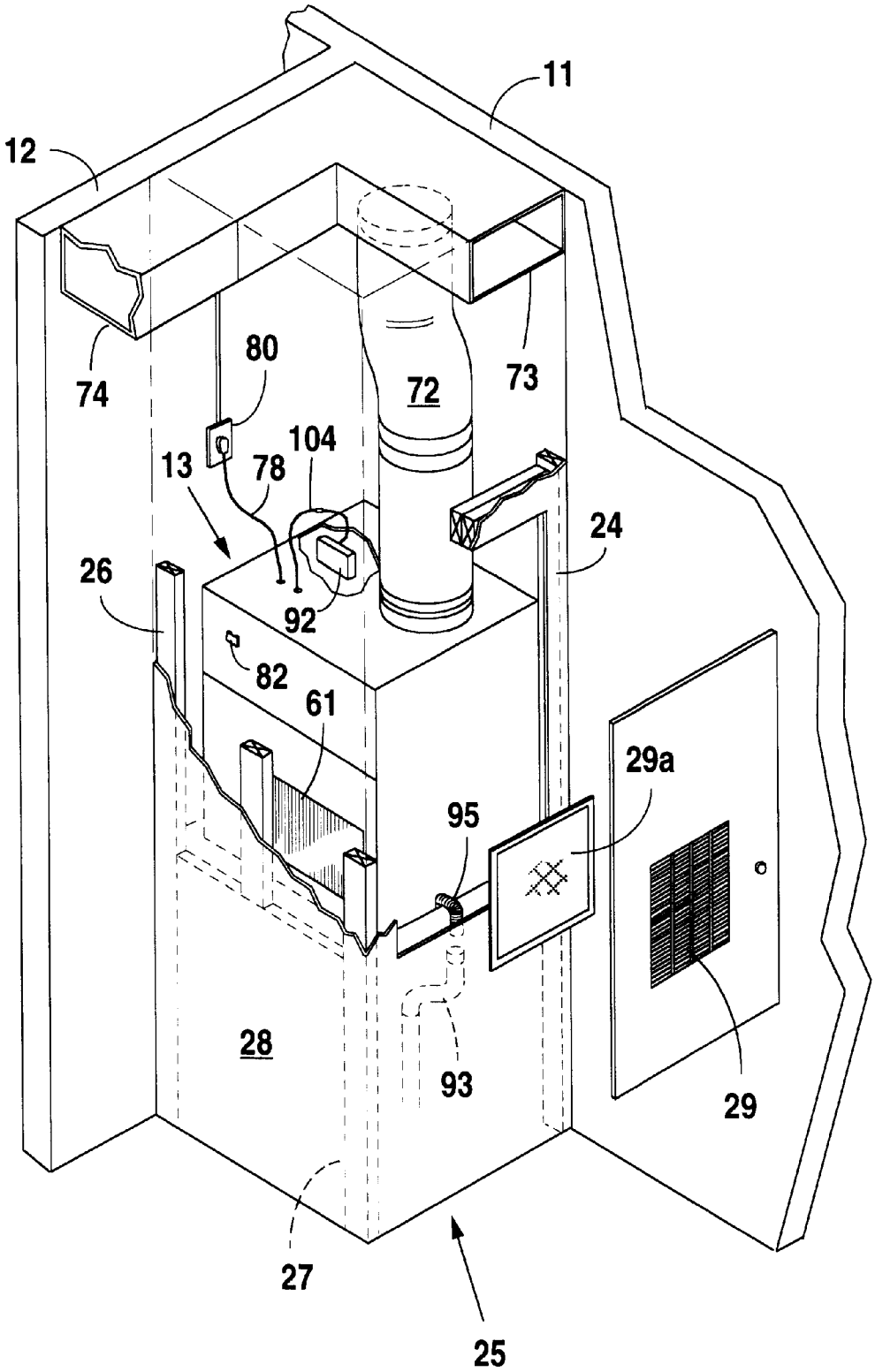
FIG. 1 is a perspective view of the air conditioning system of the present disclosure illustrated at the conjunction of an outside wall to enable heat exchange with outside air and an inside wall, thereby providing conditioned air to at least two rooms via a duct.
Figure 3:
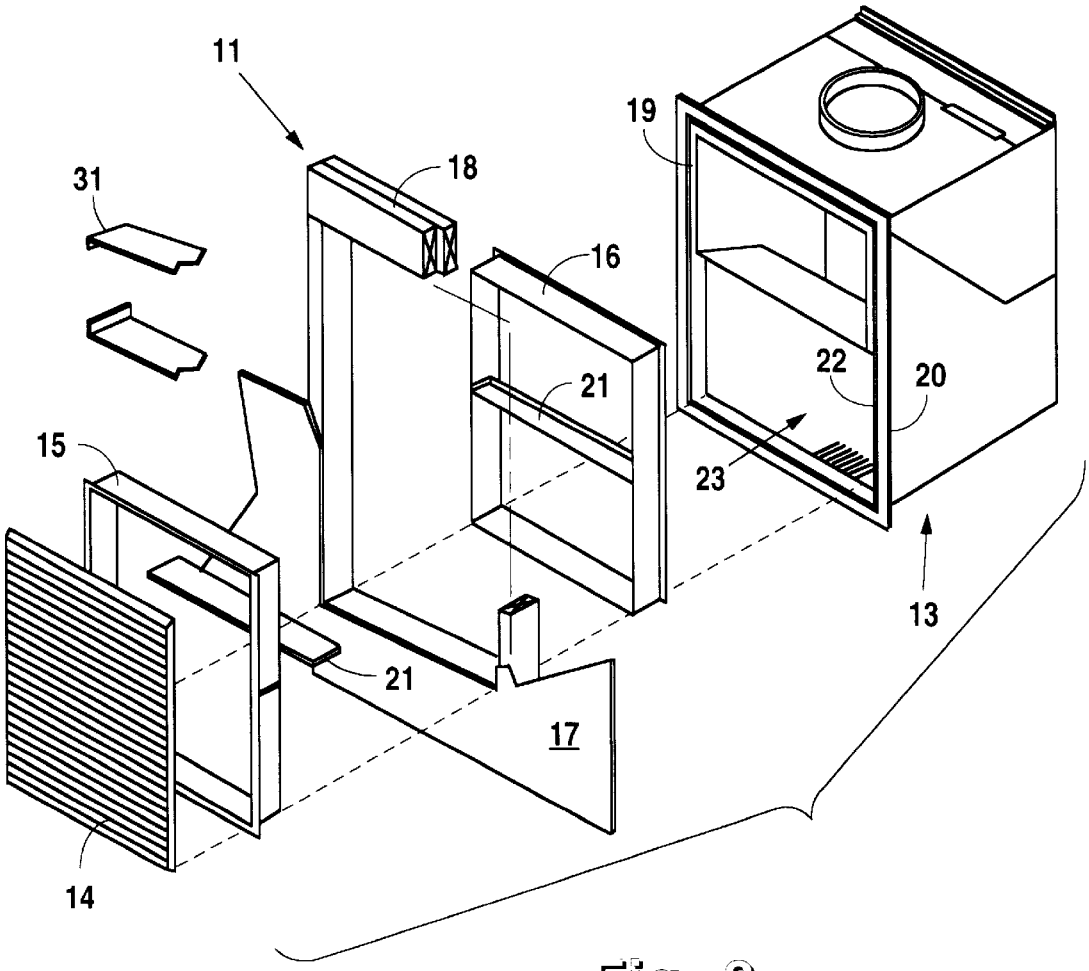
FIG. 3 of the drawings is an exploded view showing the chassis, adjustable wall plenum and outdoor louver assembly.
Figure 4C:
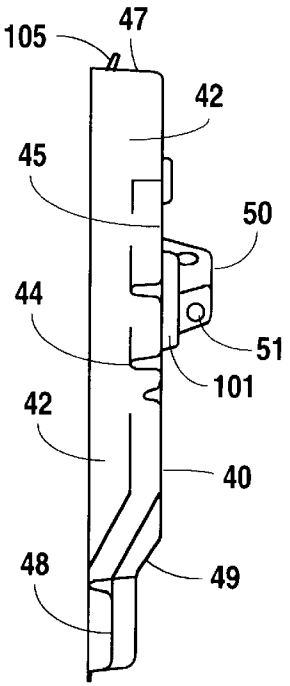
FIG. 4 is a plan view of a drain pan, including side views showing details of condensate collector and disposal areas.
Figure 4A:
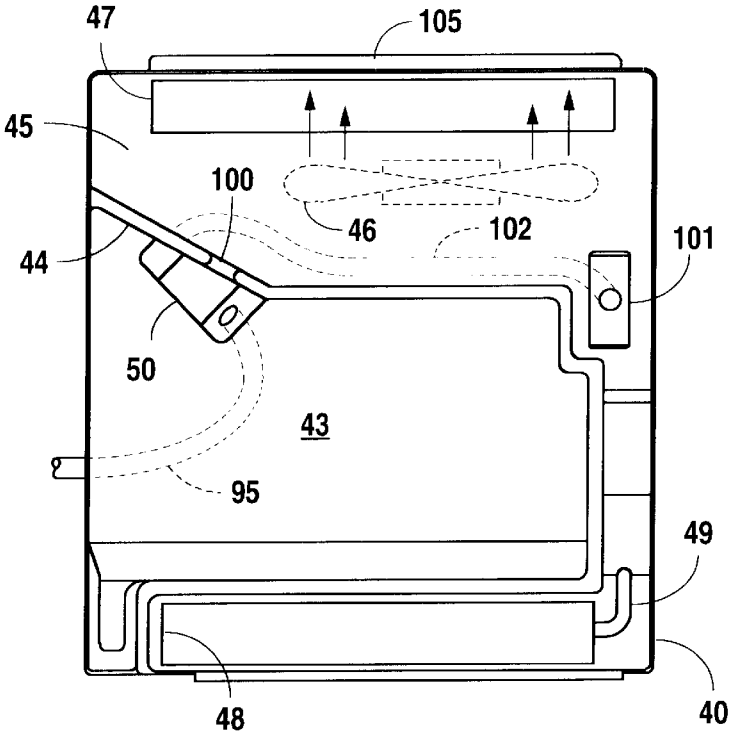
Figure 4D:
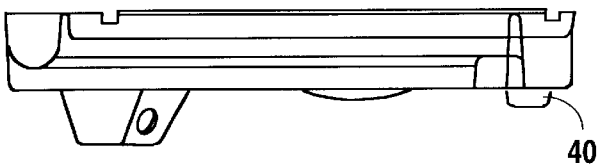
Figure 4B:
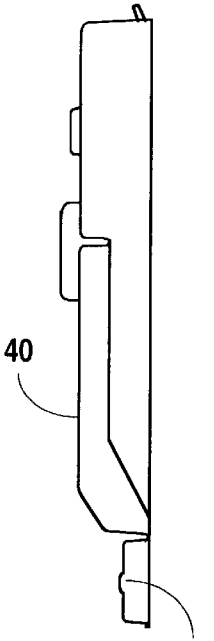

Attention is directed to FIGS. 1 and 3 jointly where the apparatus of the present disclosure is identified by the numeral 10. In FIG. 1, the entire system is shown and is located adjacent to a vertical outside wall 11 adjacent to one end of an inside wall 12. The unit is shown in a typical corner arrangement for multi-room air distribution. The air is distributed in a first room and in a second room through a duct system. The dual system can also communicate to the first room. This compact installation includes the appropriate outside louver grille for rejecting heat. While explaining the present invention, it is not necessary to go into the operating cycle of an air conditioning unit. Very briefly, an air conditioner rejects heat from the inside to the exterior of the building. The discharged heat is delivered out by the refrigerant cycle. The system can work in reverse manner when it functions as a heat pump. If in a heating mode for a heat pump, cool air from inside the building is rejected to outside air or supplemented by heating elements. The heating elements will heat the air being drawn across the heating elements. The description hereinbelow will primarily focus on a cooling function, i.e., heat is rejected into the outside air. To do that, the outside air must have access to the equipment. The equipment thus incorporates the plenum which will be described momentarily.

The equipment comprises a chassis 13 which is built with a sheet metal exterior having a hidden internal frame for rigidity and support of the equipment involved. The foot print of the chassis 13 is about 24 inches (on the square) and the height is about 32 inches. This provides a basic structure which is positioned in the corner defined by the walls 11 and 12. Consider the construction of the walls first. The inside wall 12 serves as a return air plenum and may serve as a utility closet. The wall 12 may or may not be a load bearing structure. Typically it is framed with conventional upstanding frame members. In some locations, that will be a set of 2×4 vertical frame members (sometimes wood and sometimes lightweight metal of hollow construction) and is then typically covered with sheet rock or an alternative wall covering such as particle board or the like. The wall covering typically is about one quarter to about three quarter inches in thickness. Whether sheet rock or plywood or particle board, it provides an appropriate separation between the two rooms. For the moment, simply assume that the AC unit 10 is located against the wall 12. Entries through the wall will be discussed below.

More important than the inside wall 12, the outside wall 11 separates the external air from the internal air, i.e., the conditioned air is inside of the wall 11. In this area the wall construction should also be noted. It typically is much thicker than the wall 12. It is not uncommon that the wall 11 be built (proceeding from the inside face) with a finished layer of sheet rock, a moisture barrier sometimes having the form of felt paper or reflective backing on the hidden face of the sheet rock, framing members such as 2×4s, an external layer (exemplified again by sheet plywood and a moisture barrier) and then perhaps an external covering such as shingles or brick. The wall 11, constructed with typical construction techniques, ranges from about 4.5 to about 14 inches in thickness.

The outside wall 11 must have an opening to enable heat exchange therethrough. A view of this is shown in FIG. 3. There, the opening in the outside wall is exploded and includes the external louver 14 which attaches to the periphery of a rectangular movable telescoping plenum 15. A plenum 16 is constructed to nest inside and telescope with the companion matching plenum 15. The plenum 16 has a surrounding lip which fits just inside the plenum 15 enabling the plenum 15 to move outwardly or inwardly as required. The spacing of the plenums 15 and 16 is defined by the thickness of the wall 11. The wall 11 in this particular view has been broken away. The wall 11 has been constructed with an outer sheath or covering 17 and appropriate framing members 18. This defines the opening which matches the size of the plenum 15. Architecturally, the opening is completely covered by the slats of the louver or grill 14. It is specifically designed with slats which slope downwardly to reject blowing rain. It is constructed also with sufficient free air opening to reject heat to the exterior. The plenum is comprised of the plenums 15 and 16 which telescope when installed; they adjust to a greater length to accommodate variations in wall thickness. For instance, the plenum 15 is assumed to be 6 inches in thickness; if the plenum 16 is also 6 inches in thickness, this enables the two to compress to a dimension of 6 inches or to expand to 12 inches. Note should be taken of the installation of the two plenums 15 and 16.

Each plenum 15 and 16 includes an outer encircling lip. The outer lip is incorporated for attachment to the wall 11. More specifically, the lip provides a mounting surface for the louver 14. The lip enables flush mounting on the wall 11. The lip is positioned just next to or adjacent to the wall component 17 making up the surface material of the wall 11. In like fashion, the telescoping plenum 16 can conveniently attach to the inside surface member of the wall 11. The plenums 15 and 16 telescope but the plenum 15 provides no structural support based on the connection between it and the plenum 16. Rather, they fit together conveniently for easy telescoping movement to provide an air flow path to the outside.

The plenum 16 has a specified height. Conveniently, it can be rectangular or square. It matches up against the chassis 13 at one entire side or face thereof. In this relationship, it is adjacent to a pair of openings. The plenum is bisected by a two piece transverse large horizontal divider 21. The divider 21 is incorporated to define the different flow paths for the two openings. More will be noted concerning divider 21 hereinbelow.

The outside peripheral edge 19 is a suitable mounting location for a weather strip 20. The weather strip 20 is positioned around the rectangular or square opening. The weather strip is abutted against the face 19 and jams against the plenum 16. The weather strip 20 provides a seal from outside air while allowing complete mechanical isolation from a vibrating chassis. A sealed pathway for air flow is thereby defined from the inside of the chassis out through the louver 14. Protection at the wall mounting is assured by incorporating appropriate flashing strips 31 (typically made of thin gauge sheet metal) which are installed on the frame members 18.

The dividers 21 are incorporated to divide the air flow path through the louver 14 into an inlet area and an exhaust area. Going back to the Chassis 13, it will be observed to have an upper opening 22 and a lower opening 23. The two openings 22 and 23 deliver air into and out of the louver 14. The dividers 21 in the two plenums 15 and 16 extend the divided pathway to the exterior. Connections of the openings 22 and 23 will be given below. Concluding this phase of the description, it should be noted also that the louver 14 has a height and width which approximately matches the full side of the chassis 13.

Figure 5:
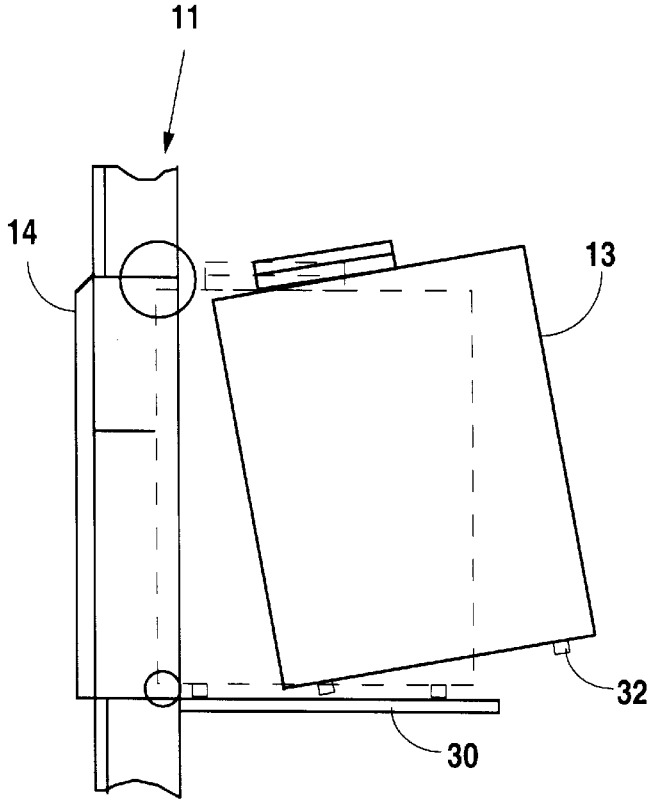
FIGS. 5 and 6 together jointly show bottom mounted shock absorbers which are controllably aligned with chassis to wall plenum during installation or removal as shown in FIG. 6.

Returning now to FIG. 1 of the drawings, the typical installation of the inside of the structure will be detailed. Again, this can be installed to provide conditioned air for two or more rooms in an apartment, hotel or assisted living facility. It can be used for two or more rooms in a hotel in a common suite subject to a single control (details will follow). Only inside of the building, the chassis 13 is installed against the wall 11. As a convenience, it is mounted against a vertical frame member 24 and is on a raised supportive base 25. The base 25 is also defined by vertical framing members 26 and 27. The frame members 24, 26, and 27 define a rectangular area beneath the chassis 13. This is closed by a sheet 28 of Sheetrock, plywood or particle board. Return air enters the closet through return air grill 29 and filter 29*a*. The return air grill 29 delivers air for flow into the closet and around the chassis 13. The return air enters chassis through indoor coil 61. An upstanding pedestal which supports the installed chassis 13. This pedestal could typically have dimensions of about 24×24 inches. It is sized to accommodate the footprint of the chassis. The pedestal incorporates a support surface 30 which is defined as a horizontal deck best shown in FIG. 5. FIG. 5 includes the outside wall 11. FIG. 5 also includes the external louver 14 which connects with suitable plenums 15 and 16. The opening is sealed by the incorporation of the weather stripping (omitted for sake of clarity) so that the chassis 13 can be positioned into the wall plenum. This positioning is done by supporting the chassis 13 on the deck 30. The chassis 13 is constructed as a rectangle which is eased against the weather stripping 20 on one side and supported on the deck 30.

Referring to FIG. 5, the chassis 13 is moved toward the horizontal position illustrated. As the chassis 13 moves toward the wall 11, the shock absorbing resilient rubber feet 32 attached at the four corners of the bottom face are ultimately rested on the deck 30. If this is done with sliding movement, there is the risk that the rubber feet 32 will be bent and left in a bent condition. That would limit the benefits of the resilient rubber feet 32. The rubber feet 32 are included to isolate the chassis 13 and thereby reduce vibrations. The rubber feet 32 are included so that the cabinet can be leveled. The deck 30 is initially level by attachment of the deck 30 to the frame members 24, 26, and 27 (FIG. 1). When the chassis 13 is in the initial position, the rubber feet 32 are preferably raised about the deck 30 so that skidding is not required. This movement assures that the cabinet or chassis 13 is brought snugly against the wall 11. The installation is accomplished in a manner in which the rubber feet 32 are not bent to the side but they remain vertical or upright.

Figure 6:
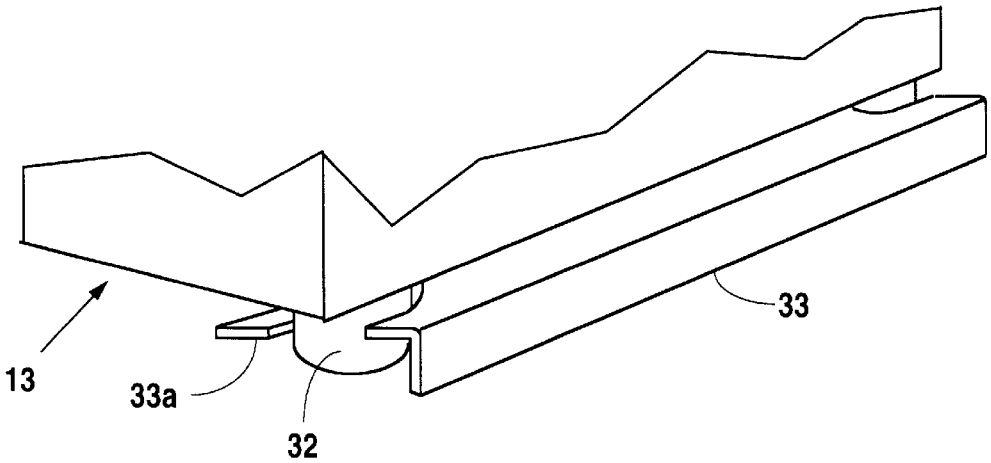

Referring to FIG. 6, it shows the chassis 13 supported on the rubber feet 32. Two of the feet are held by a keeper bar 33. The keeper bar 33 is provided with a conforming notch 33*a* at each end of the keeper bar 33 to lock two of the feet 32. Through the use of the keeper bar 33, the chassis 13 is kept in place. More specifically, the rubber feet 32 function as vibration isolators. They keep the vibration from shaking the deck 30 and distributing vibration into the nearby walls.

One important feature of this equipment is the drain pan 40 which is shown in FIG. 4 of the drawings. The drain pan 40 is at the bottom most structure under the chassis 13. For an understanding of the drain pan 40, it incorporates a surrounding lip 42 having a generally rectangular shape and surrounding the entire drain pan 40. This conforms to the footprint of the installed unit. The drain pan 40 is constructed with this lip surrounding the bottom 43. The drain pan 40 is constructed with a partition 44 extending across the drain pan 40 to define a sump area 45. The sump area 45 is lower than other parts of the drain pan 40. Water flows into the sump area 45 until it accumulates to a specified depth. The water is located in the sump area 45 so that it is picked up by the tips of a fan blade 46 shown in phantom lines. The blade 46 is rotated by a fan motor to blow air to the top of FIG. 4. The air passes through the nest of tubes functioning as a heat transfer radiator. This is the condenser coil which is installed in area 47 to reject heat out through an opening in the chassis 13 which will be discussed later.

The area 48 is the area provided for the evaporator. Water condenses on the evaporator. Area 48 in the drain pan 40 is a relatively high level. There is a downhill trough 49 extending from area 48 to lower portions of the drain pan 40. This enables the condensate to flow from the left toward the right. Water is directed over toward the partition 44. The partition 44 is a fence to keep condensate out of the area below the squirrel cage blower 63. Condensate flows away from the evaporator 61 and raised area 48 toward the lower most region 45 below the fan blade 46. The fan blade 46 slings the condensate onto the condenser coil 55.

The lower most part of the area of the drain pan 40 is in the drain sump 50. The drain sump 50 has an outlet opening 51 which is connected through a tubing as will be discussed. The drain sump 50 is the lower most point and it drains excess condensate away over notch 100 by gravity. A valve assembly (not shown) is located in a bellows sump 101 and is sensitive to and responsive to water temperatures. The valve assembly opens periodically to allow condensate to flow through a tube 102 to the drain sump 50. Alternatively, no valve is required and opening 51 may discharge condensate through gravity flow. In the optimum arrangement, a drain valve with a setting of about 40° F. is installed in the drain sump 50. It is automatically opened when the water temperature is below 40° so that all the water is drained out to prevent freezing. Otherwise, that valve is closed and water accumulates to a level so that the fan blade 46 picks up droplets of water and throws them against the coil of the condenser 55. This provides enhanced efficiency in operation of the condenser. Disposition of water collected from operation through the port 51 will be given below.

Figure 8:
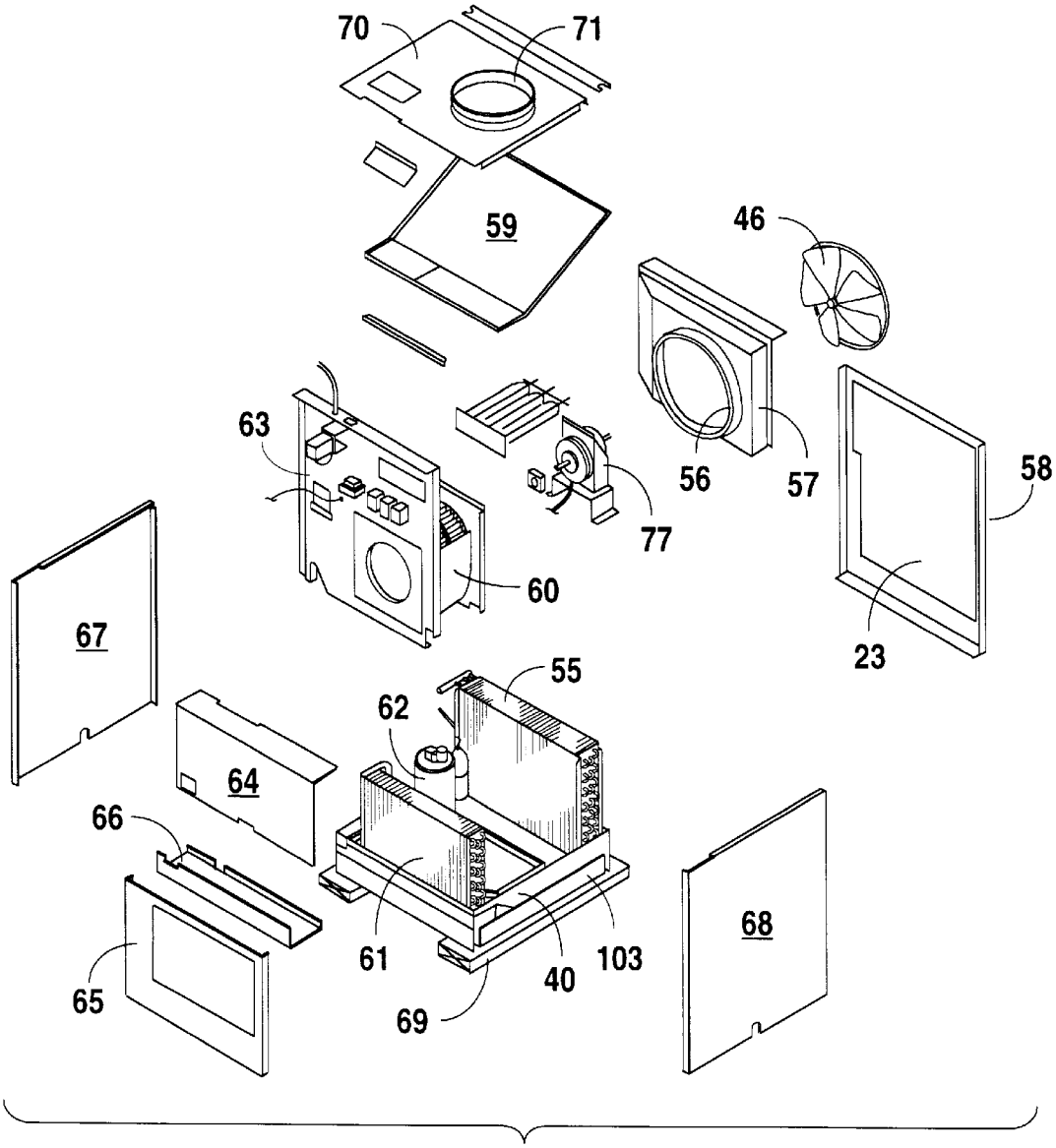
FIG. 8 is an exploded view showing details of internal components of the heating and air conditioning system.

Attention is now directed to FIG. 8 of the drawings. This shows physical placement of the equipment. Fan 46 is located to force air through the condenser 55. Air is directed outwardly through the orifice 56 in the fan shroud 57. In turn that directs air outwardly through the chassis frame member 58 which has a rectangular opening 23 on the side. Shroud 57 around the fan directs air out through the opening 23 which is in the lower reaches of the rectangular frame 58. This is an ejection route for heat. The upper portion of the frame 58 defines the second opening. A sloping angular plate 59 which extends fully across the width of the opening 22 shown in FIG. 3 separates inside air from outside air. That provides a route for fresh air from the outside which is drawn through the opening 22 to the orifice 56. In turn, the plate 59 is anchored above a squirrel cage blower 60. The blower 60 is provided with the motor 61*a* for rotation. Air is blown by the squirrel cage blower 60 over the evaporator 61. In the cooling mode, evaporator 61 provides for expansion of liquid refrigerant into a gaseous form, thereby absorbing indoor heat. This is delivered by a compressor 62 with suitable connections through a receiver and closed loop including the condenser 55, compressor 62, capillary tubes and connecting tubes. The squirrel cage blower 60 is supported on a mounting panel 63 which supports a number of operative components for the electrical controls. In general terms, this includes the various relays and transformer involved in unit control. The panel 63 is parallel to a spaced control panel 64 which supports knobs for control and operation. The panel 64 forms a control box in conjunction with a front panel 65 and is inserted through the opening in the front panel 65. The control panel 64 is easily accessible without other parts of the system having to be disassembled. Panel 66 serves as a control box bottom. In turn, these components are joined between end panels 67 and 68. The end panels 67 and 68 fasten at the ends of the control panel 64 and the component panel 63. All of these components are positioned above the drain pan 40 also shown in FIG. 8. The drain pan 40 preferably provides condensate collection for the coils. The drain pain 40 rests on a heavy gauge sheet metal base 103. Underneath, the metal base 103 as shown in FIG. 8 is the disposable shipping pallet 69.

The end panels 67 and 68 connect with a top panel 70. The top panel 70 has a circular opening and collar 71. The collar 71 is included to connect with standard 10 inches flexible duct. FIG. 1 shows the duct 72 extending upwardly into fixed ducts 73 and 74. The ducts 73 and 74 distribute conditioned air to other rooms as required. The duct 72 delivers chilled air under force from the squirrel cage blower 60 to different rooms via ducts 73 and 74.

Figure 7:
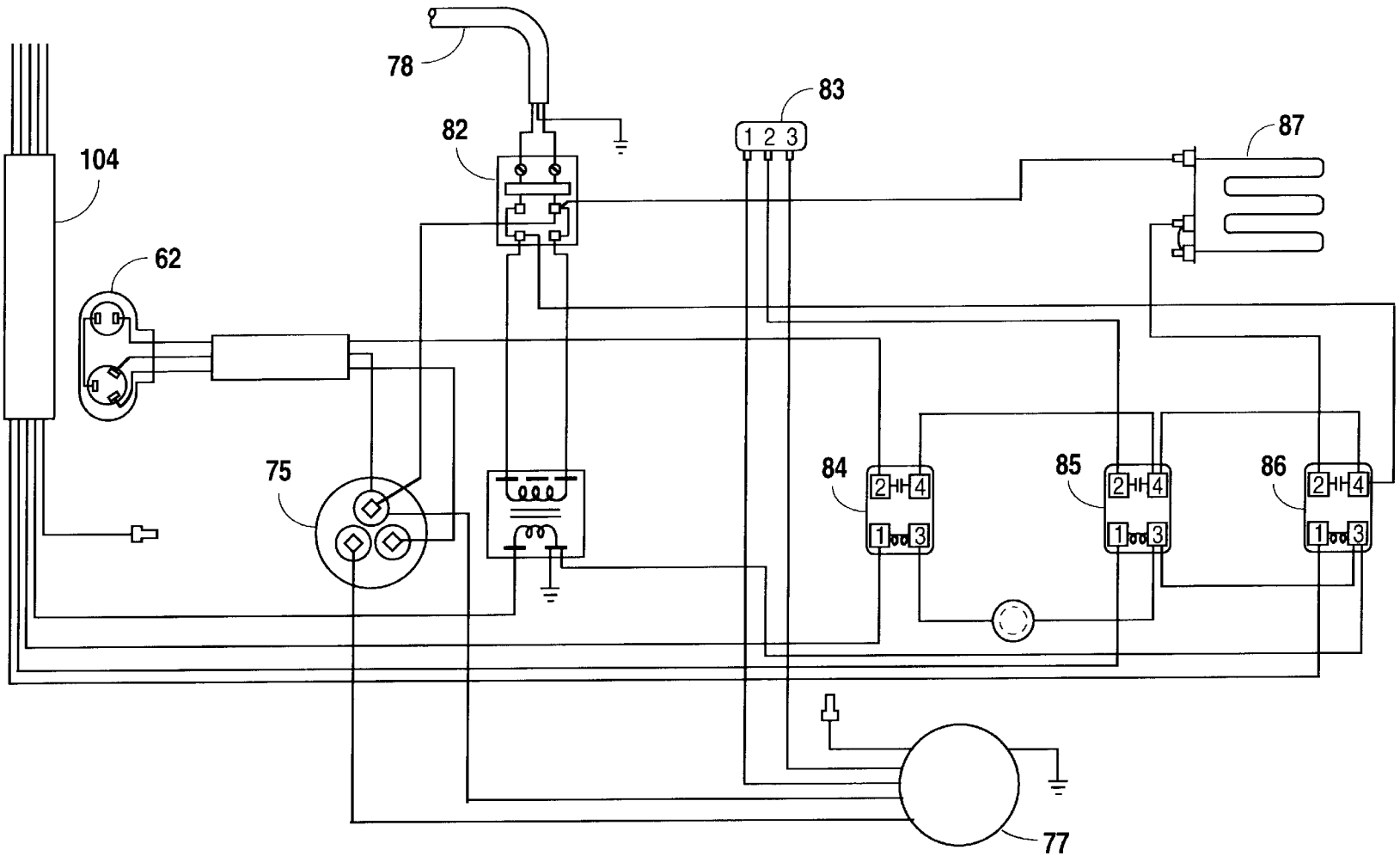
FIG. 7 is a typical wiring diagram showing electrical components of the equipment.

Attention is directed to FIG. 7 of the drawings which show major components of the control circuitry for the system. FIG. 7 is a schematic wiring diagram illustrating key components for control and operation. In that view, the compressor 62 is shown in this electrical schematic. For efficient operation, the compressor 62 and motor 77 run with the assistance of a capacitor 75. The system incorporates a motor 77 for operation of the fan and blower previously mentioned. Power is input through a power cord 78 and connects to a standard wall socket 80. (See FIG. 1.) Power is first directed through a quick disconnect fitting 82. (See FIGS. 1 and 7.) For safety and convenience, the quick disconnect must be removed before the control panel 64 can be physically opened. There is a multi speed fan switch 83 for control of the motor 77. The system also incorporates a relay 84 which operates in the cooling cycle, and further includes a fan control relay 85. A heating cycle is initiated by the heating relay 86. In turn, that controls the application of power to a heater 87. In this configuration, the heater 87 can provide resistance heat; heat can also be delivered by a heat pump cycle utilizing the compressor 62. It is believed that the similarities and differences in operation relating to a heat pump cycle are well known and can be implicated in a regular and ordinary fashion.

Figure 2:
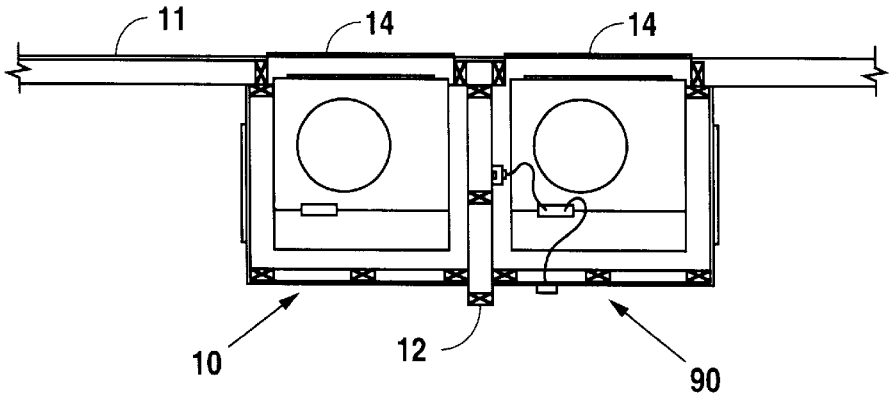
FIG. 2 of the drawings is a plan view where two such units are shown in left-hand and right-hand installation where the two units are adjacent for heat rejection to the exterior.

Attention is now directed to FIG. 2 of the drawings. This shows two of the units arranged in a side by side relationship. This is a plan view including a left system 10 and a right system 90 which are otherwise identical. Each is provided with the appropriate outlet connection to the exterior. They are both mounted for rejecting heat out through the wall 11. The wall 12 again is provided to define corners, each of the two AC units positioned in the corners in adjacent fashion.

FIG. 2 shows a variation on the theme namely the installation of two of these devices in a side by side relationship. Each is provided with an appropriate thermostat 92. The thermostat 92 is wall mounted elsewhere and connected to the unit via a factory provided quick disconnect thermostat harness 104. (See FIG. 1.)

A few details to the importance to the installation should be noted. As shown in FIG. 1, the drain pan is close to the edge as illustrated where a simple drain tube 95 is extended out from the side and connects with a drain pipe 93 connected to some suitable outlet. As appropriate, the drain pipe 93 can be turned through the wall 11 to drain on the exterior. The drain tube 95 may be flexible and telescoping with drain pipe 93 for ease of installation.

If the flexible drain tube 95 or the drain pipe 93 becomes clogged up, condensate can collect in drain pan 40. Eventually the drain pan 40 will accumulate water until it overflows drain lip 105 as shown in FIG. 4. From drain lip 105, the water will flow out through plenums 15 and 16 and subsequently out outdoor louver or grille 14 as shown in FIG. 3.

The closet which contains the chassis 13 is slightly larger in all dimensions, thereby defining an air flow space of about 3 inches in width on the left side and right side and front end. If the closet is framed and sheet rocked completely, air is introduced through the return air vent 29. It flows inside the closet and around the chassis 13 and flows into the indoor coil 61. Conditioned air then flows out through the duct 72 for distribution. Again, the thermostat 92 is installed at some remote distance across the room.

While the foregoing is directed to the preferred embodiment the scope is determined by the claims which follow.

I claim:

1. A method of installing a single package air conditioner unit in a walled structure comprising the steps of:

(a) positioning the unit against an outside wall;

(b) forming an opening through the outside wall;

(c) forming an air flow path through the wall opening through an elongated telescoping plenum enabling air flow to transfer heat between the air outside the walled structure and inside the walled structure so that said single package air conditioner unit transfers heat;

(d) forming a return air flow path communicating with said unit inside the walled structure;

(e) directing treated air from the unit to flow in the walled structure and ultimately return to said return air flow;

(f) positioning said unit in a cabinet defining at least part of the return air path;

(g) wherein said cabinet is tailored to a particular return air path dependent on the walled structure;

(h) said telescoping plenum is elongated to extend to the outer face on the wall; and said plenum is mounted to an opening defined louver at the distal end thereof and said plenum is positioned in a sealing relationship to aid single package air conditioner unit; and forming two flow paths along said plenum wherein one flow path is from inside the walled structure and the second flow path is from outside to inside the walled structure.

2. A single package air conditioner unit comprising:

(a) a single package system in a rectangular chassis having solid, closed sides;

(b) a drain pan defining a bottom side to said system;

(c) a heat forming coil in said chassis forming a heated air flow directed through a first opening;

(d) a fan directing conditioned air through said system and drawing fresh air into the conditioned air to define a fresh air flow through a second opening;

(e) a telescoping plenum extending from the one side of said chassis to enclose said heated flow and said fresh flow;

(f) a plenum mounted end located externally exposed architecturally functional louver mounted on said plenum at the distal end thereof to enable said plenum to connect said first and second openings remote from the system for the heated flow and fresh flow; and (g) first and second mating and matching plenum units telescoping together to enable contraction and elongation and thereby accommodate differences in plenum length.

3. A method of installing a single package air conditioner unit in a walled structure comprising the steps of:

(a) positioning the unit against an outside wall;

(b) forming an opening through the outside wall;

(c) forming an air flow path through the wall opening through an elongated telescoping plenum enabling air flow to transfer heat between the air outside the walled structure and inside the walled structure so that said single package air conditioner unit transfers heat;

(d) forming a return air flow path communicating with said unit inside the walled structure;

(e) directing treated air from the unit to flow in the walled structure and ultimately return to said return air flow;

(f) positioning said unit in a cabinet defining at least part of the return air path;

(g) wherein said cabinet is tailored to a particular return air path dependent on the walled structure;

(h) placing the single package air conditioning unit with drain pan on a support surface;

(i) extending a lateral hose from said drain pan;

(j) terminating the hose at a desired location; and (k) controlling hose condensate flow.

4. A method of operating a single package air conditioner unit comprising the steps of:

(a) positioning a unit having an evaporator and condenser therein against an outside building wall;

(b) defining an air flow path through the unit;

(c) forming the air flow with a fan;

(d) directing the air flow over a cooling coil;

(e) after cooling, directing the air flow from the unit;

(f) providing an air flow path deflector in the unit;

(g) inputting air to the air flow path through an unit inlet;

(h) switching the fan on or off to control air flow;

(i) forming a fresh air input into said unit;

(j) directing the fresh air input through said building wall;

(k) forming a louvered opening through said building wall so that said opening enables fresh air outside the building wall to flow therethrough;

(l) directing the fresh air input through a plenum from said louvered opening;

(m) adjusting the plenum length so that said plenum connects from said louvered opening to said unit;

(n) inside the unit, mixing the fresh air input with the fan formed air flow;

(o) attaching a flexible duct to the unit to deliver the fan directed air flow to a distal end of said duct;

(p) connecting the flexible duct to a rigid and fixed duct to distribute the fan formed air flow through an inside building wall; and (q) thermostatically controlling unit operation from across the inside building wall.

5. A single package air conditioner unit comprising:

(a) a single package system in a rectangular chassis having solid, closed sides;

(b) a drain pan defining a bottom side to said system;

(c) a heat forming coil in said chassis forming a heated air flow directed through a first opening;

(d) a fan directing conditioned air through said system and drawing fresh air into the conditioned air to define a fresh air flow through a second opening;

(e) a telescoping plenum extending from the one side of said chassis to enclose said heated flow and said fresh flow;

(f) a plenum mounted end located externally exposed architecturally functional louver mounted on said plenum at the distal end thereof to enable said plenum to connect said first and second openings remote from the system for the heated flow and fresh flow;

(g) a transverse divider across said plenum dividing said plenum in two separate passages for said heated flow and said fresh flow;

(h) a set of louvers mounted transverse to said plenum at the distal end; and (i) a transverse divider within said chassis to segregate said fresh flow from said heated flow.

6. The method of claim 1 including the step of dividing the wall opening into two portions wherein one portion comprises a part of said one flow path;

and the remaining portion comprises a part of said second flow path; and said plenum encloses a flow path divider for said flow paths.

7. The method of claim 6 wherein said two flow paths connect operatively to two separate air handling parts of said unit and said unit operates with fresh outside air along one of said flow path, and transfers heat along the other flow path.

8. The method of claim 7 wherein said plenum has a planar facing surface and including the step of positioning a seal member fully against the plenum facing surface and said unit to form a sealed connection between said plenum and said unit.

9. The method of claim 3 wherein said single package air conditioner unit drain pan;

(a) is shaped with two separate areas;

(b) is shaped with a partition between said areas;

(c) one of said areas is higher and drains water to the lower area;

(d) said lower area receives water to form a layer of water thereon;

(e) is formed with a drain opening from said lower area; and (f) is selectively drained through said drain through said hose connected thereto.

10. The method of claim 9 including the steps of:

(a) positioning a cooling fan above said lower area to remove water from said lower area in fan blown droplets;

(b) directing the fan blown droplets onto a coil rejecting unit heat; and (c) operating the unit to reject heat assisted by the fan blown droplets.

11. The method of claim 10 including the steps of:

(a) positioning unit evaporator and condenser above said drain pan;

(b) operating the unit to form water collecting on said drain pan; and (c) monitoring drain pan water temperature so that if temperature drops below above a desired temperature level, water is drained from said drain pan.

12. The method of claim 11 including the step of maintaining the unit over the drain pan, and mounting the drain pan on a set of spaced apart resilient shock absorber feet and;

(a) installing the unit on the feet at spaced locations on a surface;

(b) aligning at least two of the feet with a keeper bar during installation; and (c) maintaining the feet in an upright position.

13. The method of claim 12 including:

(a) placing the unit with drain pan on a support surface;

(b) extending a lateral drain hose from said drip pan;

(c) terminating the hose at a desired location; and (d) controlling hose water flow.

14. The method of claim 8 wherein said AC unit has a drain pan which:

(a) is shaped with two separate areas;

(b) is shaped with a partition between said areas;

(c) one of said areas is higher and drains water to the lower area;

(d) said lower area receives water to form a layer of water thereon;

(e) is formed with a drain opening from said lower area; and (f) is selectively drained through said drain through said hose connected thereto.

15. The method of claim 14 including the steps of:

(a) positioning a cooling fan above said lower area to remove water from said lower area in fan blown droplets;

(b) directing the fan blown droplets onto a coil rejecting unit heat; and (c) operating the unit to reject heat assisted by the fan blown droplets.

16. The method of claim 15 including the steps of:

(a) positioning the unit evaporator and condenser above said drain pan;

(b) operating the unit to form water collecting on said drain pan; and (c) monitoring drain pan water temperature to maintain temperature above a desired temperature level.

17. The method of claim 4 including the steps of (a) placing said unit on a support surface;

(b) mounting said unit on spaced feet;

(c) positioning said feet on a support surface;

(d) placing a removable keeper bar on said feet; and (e) aligning the feet to stand upright in a position assisted by said keeper bar.

18. The method of claim 4 including the steps of:

(a) mounting said unit confined in a fabricated closet with an air flow space therearound;

(b) collecting unit water condensed thereby on a drain pan below said unit;

(c) positioning an outlet waste water line from the drain pan to dispose of the water;

(d) installing a remote thermostat to control unit operation;

(e) installing an electrical power plug adjacent to the unit; and (f) demounting the unit for service while replacing the unit during service with a second unit having the same size and connections.

19. The method of claim 18 including the steps of defining air flow paths to said unit including air flow into and from openings in a chassis containing said unit and placing said air flow openings of said chassis in connection with external air flow paths so that leakage from the air flow paths is limited.

20. The apparatus of claim 2 further including:

(a) a wall connecting flange at the distal end of said plenum;

(b) a wall defining flash member mounting against the wall to enable said plenum to extend through a wall; and (c) an inside wall located weather strip for the proximal end of said plenum.

21. The apparatus of claim 5 further wherein said drain pan comprises:

(a) a transverse drain pan having a surrounding peripheral upstanding lip to prevent water accumulated on the drain pan from flowing over the sides of said drain pan;

(b) a transverse wall across said drain pan to define said drain pan into upper and lower areas wherein said lower area defines a greater depth for accumulating water thereon; and (c) wherein said lower area is positioned beneath said system below a fan mounted therein for blowing cooling air over a heat radiating coil assembly.

22. The apparatus of claim 21 further including;

(a) an upper area in said drain pan adapted to be located beneath said system so that humidity in the air flow passing therethrough condenses and falls to said upper area;

(b) a flow path from said upper area to said lower area to drain said upper area to said lower area;

(c) a sump communicating with said lower area for receiving a drain valve therein;

(d) an outlet drain opening cooperative with said drain valve to selectively drain said lower area;

(e) a temperature responsive, sump located, drain valve for controllably draining said sump and said lower upon temperature dropping below a predetermined level.

23. The apparatus of claim 22 wherein said drain pan comprises a portion of said chassis and is structurally incorporated below said system including a compressor, evaporator, and condenser in said system and further wherein said drain pan is structurally supported on a set of spaced resilient shock absorbing feet deployed toward the corners of said system wherein said system has a rectangular footprint and said sump in said drain pan is located so that a drain line is connected with said drain opening to extend laterally from said system.

24. The apparatus of claim 23 wherein said feet are upstanding cylindrical rubber plugs adapted to flex so that vibrations in said system are isolated thereby, and further including an alignment notch in a keeper bar engaging at least two of the rubber feet for alignment.

25. The apparatus of claim 24 wherein said resilient rubber feet are supported on a horizontal surface accommodating the installed rectangular footprint of said system, and define a gap through which said drain hose is positioned from said sump.

26. The apparatus of claim 25 wherein said chassis comprises a six sided system wherein said drain pan and base comprise the bottom side thereof, and including a top side at the top end thereof having a duct connected opening so that conditioned air from said system is directed through said opening and into a flexible duct connected thereto, and further including a return air opening in said system.

* * * * *